US008939392B2

(12) United States Patent
Granger

(10) Patent No.: US 8,939,392 B2
(45) Date of Patent: Jan. 27, 2015

(54) APPARATUS FOR DISPENSING A PRE-CUT WIPING MATERIAL WOUND INTO A COIL

(76) Inventor: Maurice Granger, St. Priest en Jarez (FR)

( * ) Notice: Subject to any disclaimer, the term of this patent is extended or adjusted under 35 U.S.C. 154(b) by 782 days.

(21) Appl. No.: 13/146,732

(22) PCT Filed: Nov. 10, 2009

(86) PCT No.: PCT/FR2009/052161
§ 371 (c)(1),
(2), (4) Date: Jul. 28, 2011

(87) PCT Pub. No.: WO2010/089467
PCT Pub. Date: Aug. 12, 2010

(65) Prior Publication Data

US 2011/0284681 A1 Nov. 24, 2011

(30) Foreign Application Priority Data

Feb. 5, 2009 (FR) ..... 09 50695

(51) Int. Cl.
*B65H 49/20* (2006.01)
*A47K 10/34* (2006.01)

(52) U.S. Cl.
CPC ..... *A47K 10/34* (2013.01)
USPC ..... 242/596.8; 242/596.3; 242/598.5

(58) Field of Classification Search
USPC ..... 242/596, 596.3, 596.4, 596.5, 596.8, 242/598.5, 598.6, 580
See application file for complete search history.

(56) References Cited

U.S. PATENT DOCUMENTS

| | | | | |
|---|---|---|---|---|
| 2,608,356 | A * | 8/1952 | McDonald et al. | 83/223 |
| 2,637,503 | A * | 5/1953 | Birr | 242/596.8 |
| 2,711,860 | A * | 6/1955 | Layton | 242/596.3 |
| 3,998,120 | A | 12/1976 | Granger et al. | |
| 7,637,190 | B2 * | 12/2009 | Granger | 83/337 |
| 2001/0052559 | A1 * | 12/2001 | Inana et al. | 242/348 |

FOREIGN PATENT DOCUMENTS

| | | | |
|---|---|---|---|
| EP | 387160 | A1 | 3/1990 |
| WO | 2010030226 | A1 | 5/2001 |

OTHER PUBLICATIONS

International Search Report for PCT/FR2009/052161 dated Mar. 5, 2010.

* cited by examiner

*Primary Examiner* — William A Rivera
(74) *Attorney, Agent, or Firm* — Heslin Rothenberg Farley & Mesiti P.C.

(57) ABSTRACT

A dispensing machine for pre-cut wipe material wound on a reel includes a wall-mounted housing with a back panel, two side panels, a lower base panel, and a cover articulated relative to said housing by lifting the cover upwards. The back panel accommodates a module having two lateral side pieces to receive the reel of material. The dispensing machine includes a compensating lever mechanism to move the strip of pre-cut material rearwardly in close combination with lifting or lowering of the cover. The mechanism is externally located either side of the lateral side pieces in the space between the lateral side pieces and the side panels. The mechanism comprises two levers articulated together and mounting a return roller. The first lever has a uniform structure and the second lever has various components which allow Cardan-joint type articulation. The levers are linked to arms connected to the cover.

10 Claims, 7 Drawing Sheets

Fig. 10
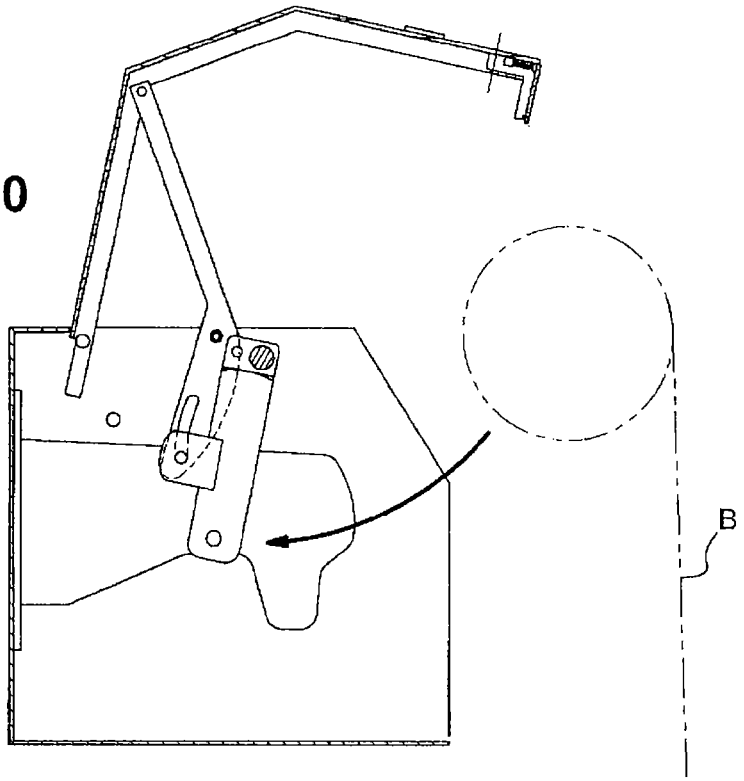
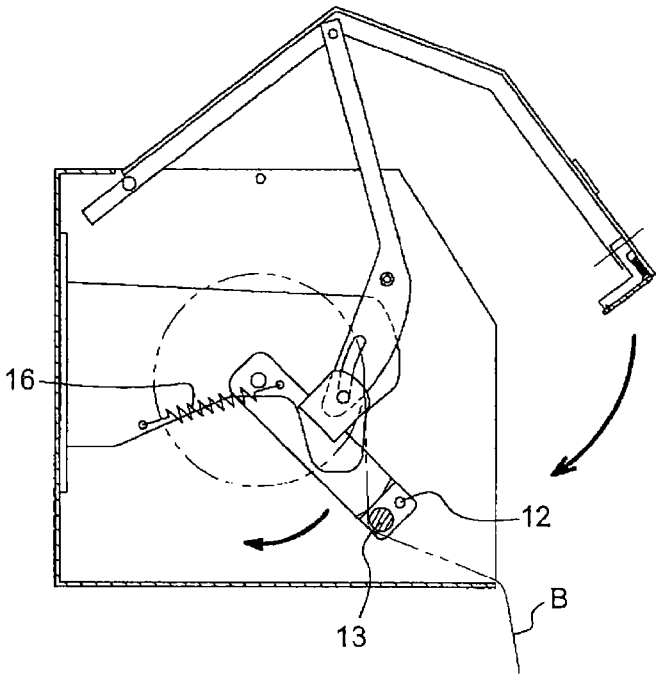
Fig. 11

Fig. 12
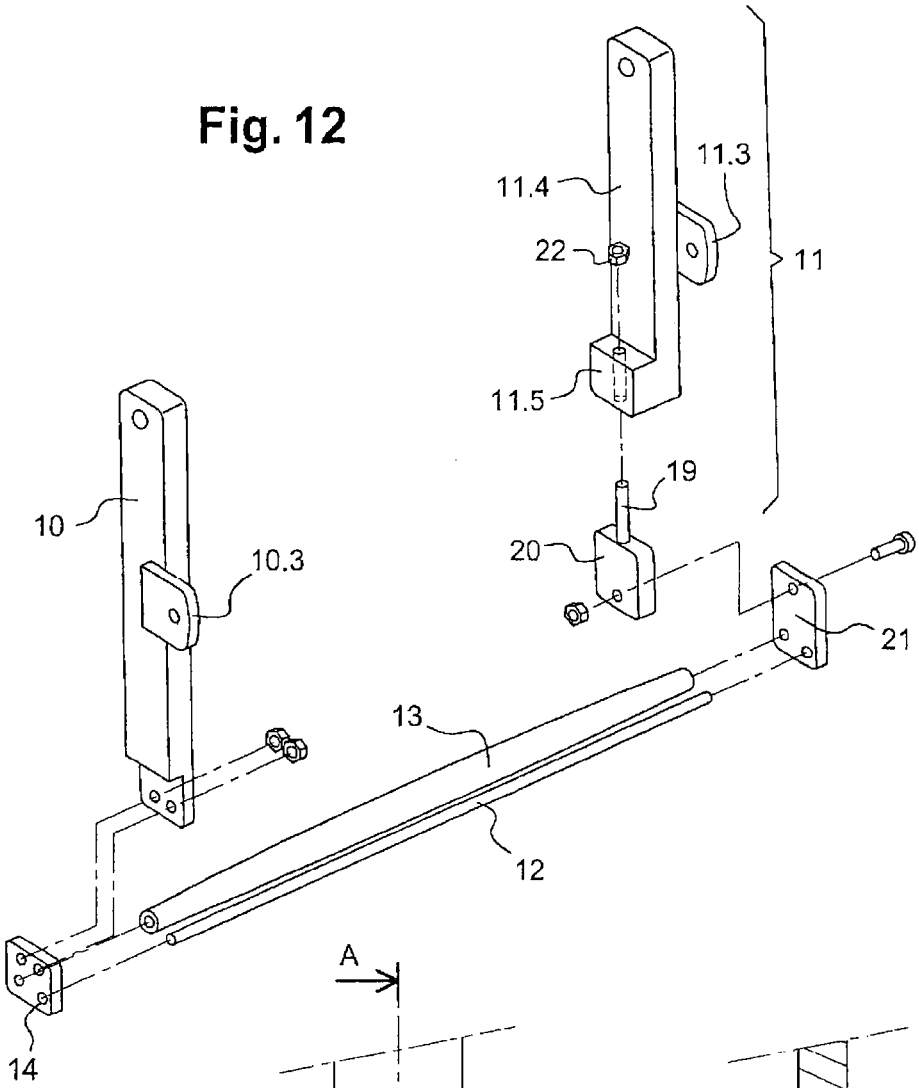
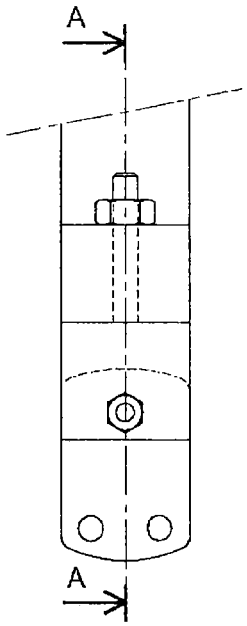
Fig. 13
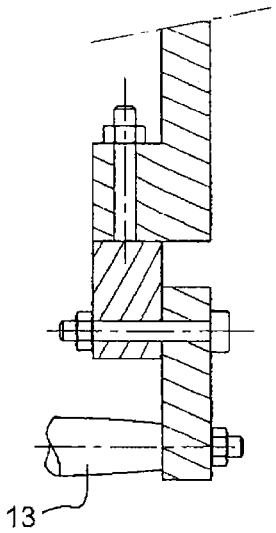
Fig. 14

APPARATUS FOR DISPENSING A PRE-CUT WIPING MATERIAL WOUND INTO A COIL

CROSS REFERENCE TO RELATED APPLICATIONS

This application is a national stage filing under section 371 of International Application No. PCT/FR2009/052161 filed on Nov. 10, 2009, and published in French on Aug. 12, 2010 as WO 2010/089467 and claims priority of French application No. 0950695 filed on Feb. 5, 2009, the entire disclosure of these applications being hereby incorporated herein by reference.

BACKGROUND ART

The invention relates to the technical field of dispensing machines for wipe materials of the basewad paper type for hand wipe, toilet paper and general-purpose wiping and cleaning applications.

The wipe material may be presented in various configurations which have all been the subject of design work and research carried out by the Applicant who has specialised in dispensing machine technology for roughly 40 years and has filed a very large number of patents.

The wipe material may be wound on a reel and be dispensed by dispensing machines which include a cutting device with automatic or semi-automatic operation. These machines make it possible to use a cutting device located in a drum to cut materials to a predetermined format.

The wipe material may be accordion-pleated by a special-purpose mechanism with a built-in cutting device. An example of this is described in Patent EP 387160.

The wipe material can be pre-cut and, in this case, it is accordion pleated in successive folds. In this configuration, the volume of the material to be dispensed remains compact and, in every case, there is no comparison with a strip of material wound on a reel.

The problem to be resolved by the Applicant is to design a dispensing machine for pre-cut wipe materials wound on a reel.

As far as the Applicant is aware, there is no dispensing machine which meets this criterion. Various attempts to design such a machine have been made but have eventually been abandoned due to major unresolved problems relating to the random nature of the pulling force exerted on the material by the user and the direction of this force. The fact that the wipe material is pre-cut makes it legitimate to question whether there is any need for there to be a cutting device at all. The problem to be resolved then becomes mainly the fact that the wipe material is grasped and removed by users exerting highly variable pulling forces in highly variable directions which interfere with cutting of the strip of material inside the machine and therefore cause malfunctioning During maintenance, the dispensing machine then has to be reopened and refilled appropriately, i.e. a strip of material has to be left emerging from the machine so that it can be grasped. This is the major difficulty which has prevented the dispensing of pre-cut wipe material wound on a reel.

Having defined the problem to be solved, the Applicant then carried out work and conducted various design studies with the aim of reliably and continuously meeting the need to dispense pre-cut wipe material wound on a reel.

In the context of all this work and research on wipe material dispensing machines in general, the Applicant has developed the concept of a compensating lever which is articulated relative to the housing of the machine, enabling it to act on the strip of material and retract towards the rear of the machine by swiveling through an angle which is proportional to the pulling force. This makes it possible to prevent excessive tensioning of the material, thus avoiding inopportune breaking of the strip of material. This is described in Patent EP 387160.

The Applicant also devised and perfected, in Patent PCT WO01/30226, the possibility of a pressure roller capable of being elastically pressed against a drum which accommodates a cutting device through the intermediary of two independently articulated levers which make it possible to follow unwinding of the strip of material as a function of the orientation of the pulling force relative to the dispensing machine. In this case, the two levers are structurally identical and attached relative to the side pieces of the housing of the machine and their other end is connected to the pressure roller. It is therefore possible for the two levers to "wiggle" in order to follow and absorb the effects of the wipe material being pulled.

Building on the facts disclosed in these two patents, the Applicant therefore tried to incorporate this solution in a machine for dispensing pre-cut wipe material.

In practice, transferring the knowledge disclosed in these two solutions does not make it possible to ensure reliable operation and dispensing because the Applicant observed jamming of the mechanisms in question.

Building on these documents, the Applicant's approach was therefore to look for a reliable solution, taking into account the environment of the dispensing machine without a cutting device and therefore without a drum against which the strip of material is pressed, in particular in Patent WO 01/30226.

The solution devised by the Applicant solves the problem posed very effectively and resolves the stated drawbacks. This solution is simple and inexpensive to implement.

Building on this solution, the Applicant also wanted to make the machine for dispensing pre-cut wipe material more safe by monitoring the dispensing and ejection of the strip of material using a flame-arrester effect.

Dispensing machines fitted with all these features are therefore very dependable and perform well.

BRIEF SUMMARY OF INVENTION

According to a first aspect, the dispensing machine for wipe material wound on a reel of the type comprising a wall-mounted housing with a back panel, two side panels, a lower base panel and a cover which is articulated relative to said housing by lifting it upwards, said back panel accommodating a module which itself has a back panel and two lateral side pieces shaped and designed to receive the reel of material, the dispensing machine being designed to accommodate a compensating lever mechanism intended to move the strip of pre-cut material back towards the rear of the machine and do so in close combination with lifting or lowering of the cover, is distinctive in that the compensating-lever mechanism is externally located either side of the lateral side pieces of the module in the space formed with the lateral side pieces of the housing and in that said mechanism comprises two levers which are articulated with each other and between which there is at least one return roller and in that the first lever has a uniform structure and the second lever is designed with various components which allow Cardan-joint type articulation and in that the levers are linked to arms which make it possible to lift or lower the cover and in that the material wound on a reel is pre-cut.

These aspects and others will become apparent from the rest of the description.

BRIEF DESCRIPTION OF DRAWING FIGURES

The object of the present invention is described, merely by way of example, in the accompanying drawings in which:

FIG. 10 is a cross-sectional view showing the dispensing machine with its cover opened and a reel of material being loaded.

FIG. 11 is a view which is substantially identical to FIG. 10 but when the cover is being closed.

FIG. 12 is a view before assembly of the compensating lever which moves the wipe material back towards the rear of the dispensing machine FIG. 13 is a partial side view of the articulated arm which constitutes a point of contact with the compensating lever shown in FIG. 11.

FIG. 14 is a cross-sectional view along line A-A in FIG. 13.

DETAILED DESCRIPTION

In order that the object of the invention may more readily be understood, the following description is given, merely by way of example, reference being made to the accompanying drawings.

Figure 7:
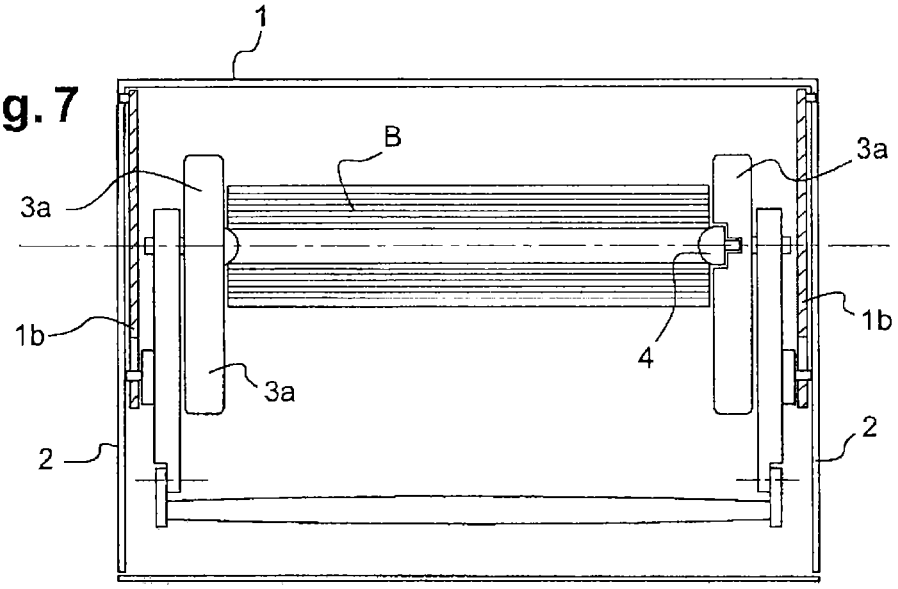
FIG. 7 is a top view of the dispensing machine according to the invention.

The wipe material dispensing machine is represented in its entirety as A and comprises a wall-mounted housing (1) with a back panel (1*a*), two side panels (1*b*), a lower base panel (1*c*) and a cover (2) which is articulated relative to said housing by lifting it upwards. The back panel (1*a*) receives a module (3) which itself has a back panel (3*a*) and two lateral side pieces (3*b*) shaped and designed in a known manner in order to receive reel (B) of pre-cut wipe material; line (b1) represents a perforation line. The reel of material is held by convex shapes (4) on lateral side pieces (3*b*) with at least one of the side pieces having the capacity of elastic deformation in a known manner in order to make it possible to position the strip of material. FIG. 7 shows two convex shapes (4); the shape on the right may be rotatably mounted to follow unwinding of the reel and the other shape may be fixed. In the case of the fixed shape, there may be an end fitting which penetrates into the core with an external finger which positions itself in a slot on the corresponding opposite-facing side piece. These arrangements and features are known in themselves and are only mentioned here to make the invention more readily understandable.

Figure 1:
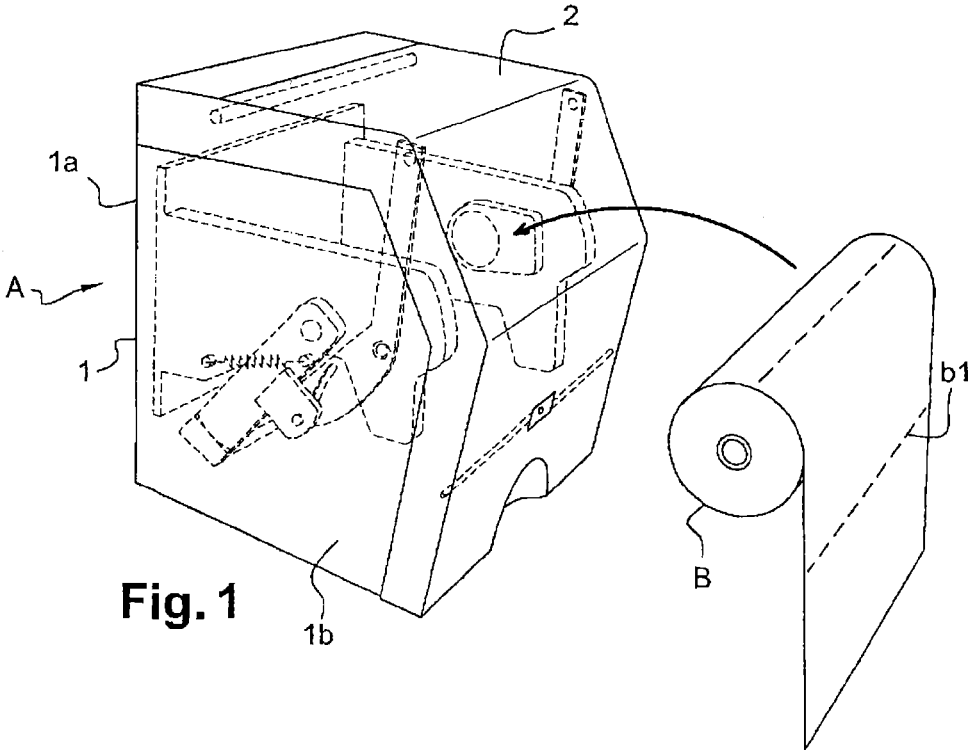
FIG. 1 is a schematic perspective view of the dispensing machine for pre-cut wipe material according to the invention and shows the reel separately.
Figure 2:
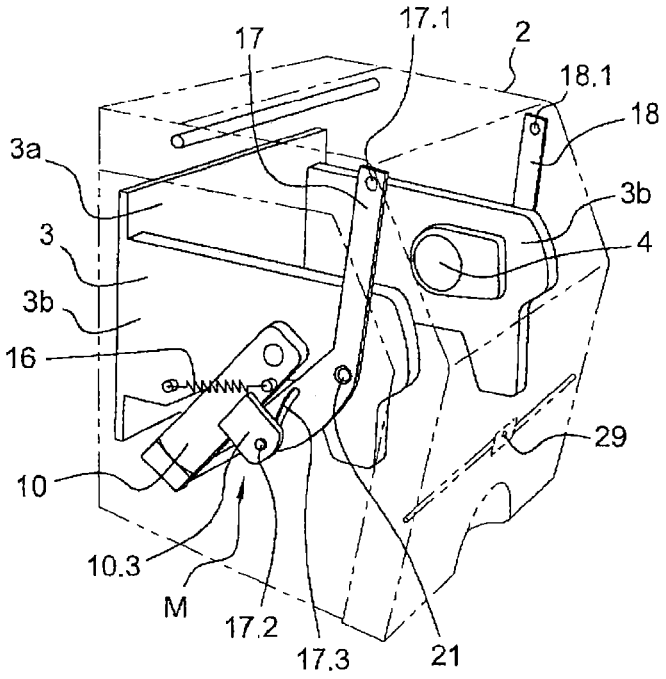
FIG. 2 is a view of the dispensing machine shown in FIG. 1 with a "see-through" cover showing its internal mechanism in a dashed line.
Figure 3:
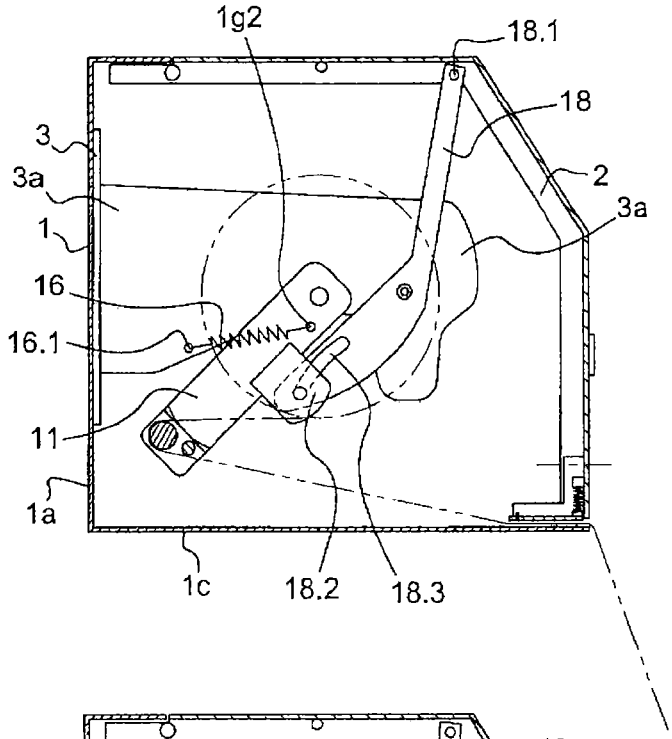
FIG. 3 is a cross-sectional view of the dispensing machine when it is closed.
Figure 4:
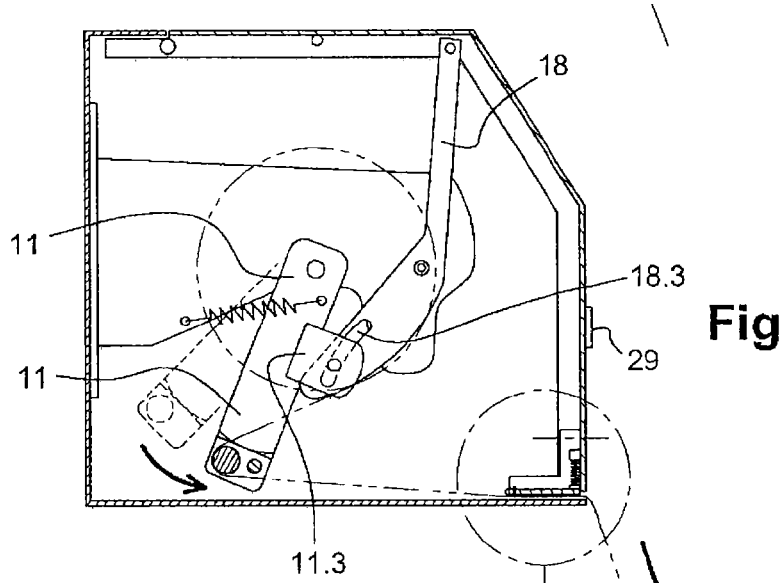
FIG. 4 is a cross-sectional view as shown in FIG. 3 but when the user pulls on the wipe material and showing the compensating-lever mechanism.

The dispensing machine according to the invention is designed to accommodate a compensating-lever mechanism referred to in its entirety as (M) which is shown, in particular, in FIG. 2 and intended to move the pre-cut strip of material back towards the rear of the machine and do so in close combination with lifting or lowering of the cover. This mechanism is externally located either side of the lateral side pieces (3*b*) of the module in the space formed with the lateral side pieces (1*b*) of the housing.

The mechanism which fulfils a compensating-lever function thus comprises two levers (10) and (11), whereof the bases (10.1) (11.1) are articulated on the side pieces of the module. The upper part of these two levers (10) (11) are spread apart by a spacing bar (12) and also by a return roller (13) against which the strip of material is pressed and guided as it is unwound from the reel. The spacing bar is immovably fixed whereas the return roller is rotatably mounted by shafts (14) located at the ends of levers (10) and (11). The lower parts of levers (10) and (11) each have a means of attachment and elastic return in the form of a spring (16). One end (16.1) of the spring is attached to the outer side of side piece (3*a*) of the opposite-facing module and its other end (16.2) is attached to said lever (10.11). When the cover is raised, return means (16) is not tensioned.

Each lever (10.11) is connected to cover (2) by a shaped link arm (17.18). The first end (17.1-18.1) of said arms is attached to the upper part of cover (2). The other end (17.2-18.2) is attached to levers (10.11) by a deflection tab (10.3-11.3) formed on the levers. The arms (17-18) are designed with a curved slot (17.3-18.3) close to their connecting part, this makes it possible to position and move the shaft associated with the above-mentioned deflection tabs, thereby making it possible to follow and guide the compensating lever as the cover is closed. Lever (10) has a fixed, uniform structure.

Figure 15:
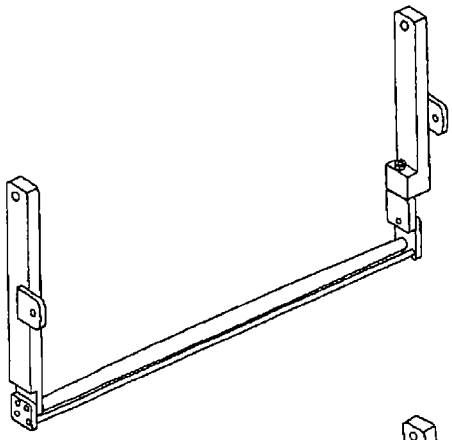
FIGS. 15 and 16 are views of the compensating lever in various positions.
Figure 16:
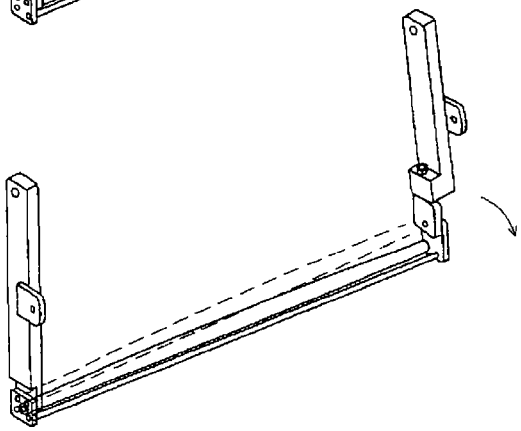

According to the invention, second lever (11) is designed with various components which make it possible to ensure Cardan-joint type articulation. As shown in FIGS. 12, 13 and 14 in particular, said lever (11) comprises a long main part (11.4) which starts from its lower end which receives the deflection tab used to articulate the arm of the cover. This main part (11.4) has an inner offset (11.5) capable of receiving a shaft (19). A link (20) which is itself linked to a plate (21) capable of allowing attachment of the return roller and the above-mentioned spacing bar is articulatedly located on this offset. Link (20) and inner offset (11.5) are connected to each other by pin (19) with a lock screw (22). Thus, in this particular setup, lever (11) differs from lever (10) in that it makes it possible for its components to be articulated in the same way as a universal joint, this being done in order to absorb the various forces and directions associated with the user pulling the strip of material. As shown in FIGS. 15 and 16, this produces deliberate misalignment in all the planes of lever (11) compared with lever (10) depending on the force exerted. It is this very special arrangement which enables the dispensing machine to operate correctly in applications which involve dispensing a reel of pre-cut wipe material.

Obviously, the opposite-facing parts of part (20) and offset (19) are designed to allow articulated linkage and are therefore not flat but substantially oppositely convex in order to allow such articulation.

Figure 8:
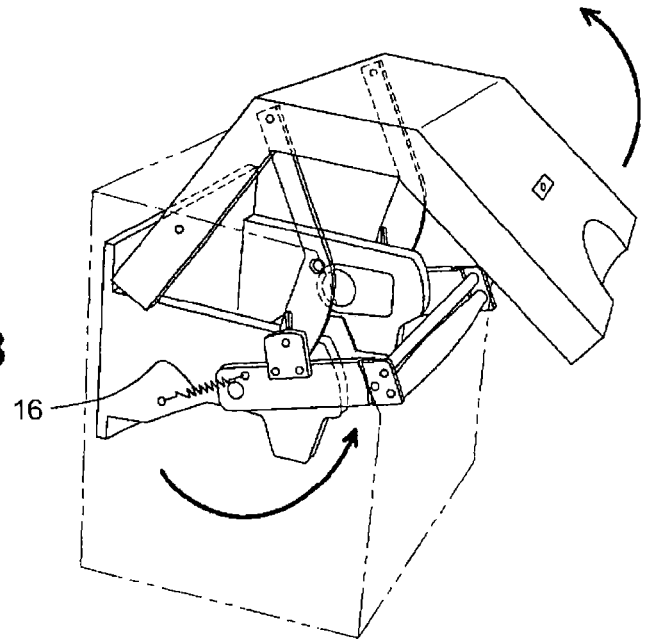
FIG. 8 is a perspective view of the dispensing machine when the cover is opened.
Figure 9A:
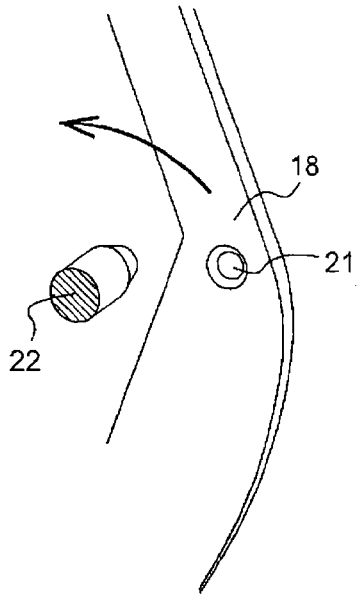
FIGS. 9A and 9B are partial views showing how one of the arms associated with the cover is locked in position when the cover is lifted.
Figure 9B:
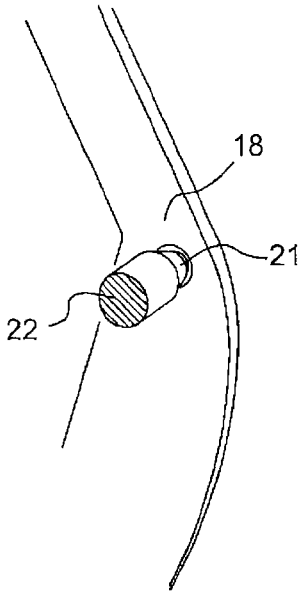

In FIGS. 8, 9A and 9B, at least one of the hinge arms of the cover has an opening (21) in its middle part to allow positioning of locking means (22) formed on the side panel of the housing in order to ensure temporary locking in position of the cover when it is raised. This temporarily connection is obtained by simply squeezing or pre-centring locking means (22) in opening (21) because it must be possible to release this connection so that the cover can be easily closed.

Figure 5:
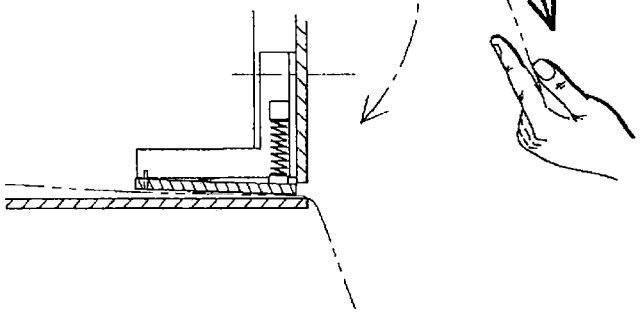
FIG. 5 is a larger scale view of the circled part in FIG. 4 showing removal of the wipe material.
Figure 6:
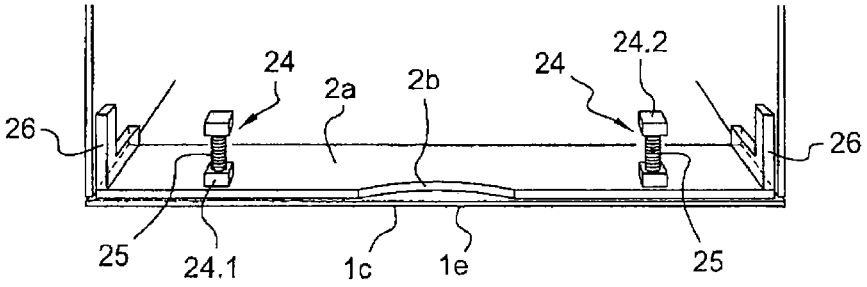
FIG. 6 is a partial view showing the means located on the cover and the back of the housing for removing the strip of material.

The feature allowing the strip of material to be removed from the housing of the machine is described below. This is shown in FIGS. 5, 6 and 17 in particular.

The Applicant uses safety elements which function as a flame arrester.

For this purpose, the front part of the base (1*c*) of the housing has a central curved cut-out (1*e*). Lengthwise and on its free end, cover (2) has a plate (2*a*) with the capacity of elastic deformation in opposition to pressure means (24). This plate (2.1) is placed on top of base panel (1*c*) leaving a gap through which the emerging strip of material can pass. The central area of this panel (2*a*) also has a curved cut-out (2*b*) located vertically above the above-mentioned cut-out (1*e*). Two embodiments are shown in the above-mentioned Figures, these ensure elastic deformation of panel (2.1). In the version in FIGS. 5 and 6, panel (2*a*) presses against the end of L shaped elements (26) which are integral with the front panel of the housing. The pressure means (24) are realised in the form of two supports (24.1-24.2) which between them accommodate spring-type elastic means (25). Support (24.1) is integral with the inner face of panel (2*a*). Support (24.2) is internally integral with the inner face of the cover. When pulling the strip of material exerts pressure, plate (2*a*) moves upwards and compresses springs (25).

Figure 17:
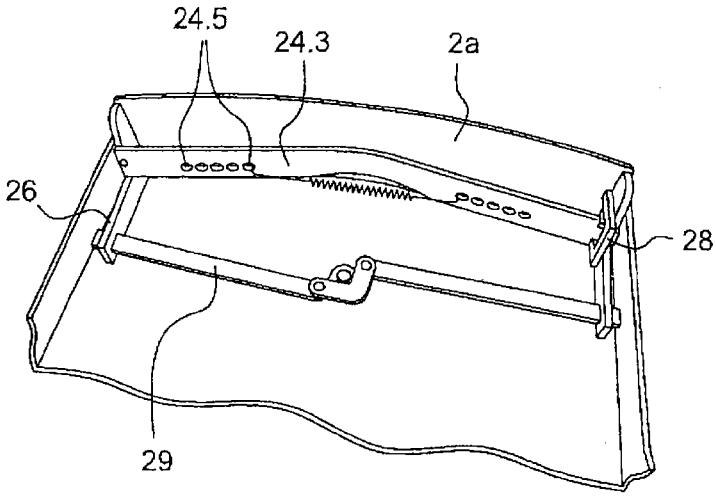
FIG. 17 is an alternative view of the flame-arrester device where the strip of material emerges.

In the version shown in FIG. 17, pressure means (24) are designed differently with a long, longitudinal leaf (24.3), the ends of which are attached to above-mentioned L shaped elements (26) and the central part (24.4) of which presses against the front panel of the cover. Elastic means (27) of the spring type links the ends of the leaf using various fixing possibilities provided by predetermined positioning holes (24.5). To ensure assembly, one of the ends of the leaf hooks into a connecting part (28) which is integral with an L shaped element (26). The other end of the leaf is attached to the other opposite-facing L shaped element.

A locking mechanism (29) is shown by way of example.

The operation of the machine is described below. Initially, the cover is fully raised and locked in position. The operator installs a reel of material between side pieces (3*a*). The strip of material hangs out of the front of the machine. The operator closes the cover by unlocking the fasteners. This causes downward hinged movement of the cover and swiveling of the compensating lever as far as the rear of the machine and moves the hanging part of the strip of material rearwards. When the cover is closed, the end of the strip emerges and can be grasped by the user.

When operational, the compensating lever moves systematically depending on the tensile forces exerted and their direction and the compensating lever changes its shape thanks to universal joint lever (11) by absorbing the stresses associated with these forces.

The advantages are readily apparent from the description. One must emphasise that, for the first time ever, this invention makes it possible to dispense a pre-cut strip of material wound on a reel from a dispensing machine.

The proposed solution is simple and practical—tests have been performed and have validated this embodiment.

The invention claimed is:

1. Dispensing machine for a strip of pre-cut wipe material wound on a reel, comprising a wall-mounted housing with a back panel, two side panels, a lower base panel and a cover articulated relative to said housing by lifting the cover upwards, said back panel accommodating a module having a back panel and two lateral side pieces shaped to receive the reel of material, the dispensing machine further comprising a compensating-lever mechanism adapted to move the strip of pre-cut material back towards a rear of the machine in close combination with lifting or lowering of the cover, wherein the compensating-lever mechanism is externally located either side of the lateral side pieces of the module in a space formed between the lateral side pieces and the side panels of the housing, and said mechanism comprises two levers articulated with each other and having at least one return roller mounted between the two levers, and a first lever of said two levers has a uniform structure and a second lever of said two levers facilitates Cardan-joint type articulation and the levers are linked to arms permitting lifting and lowering of the cover.

2. Dispensing machine as claimed in claim 1, wherein bases of the two levers are articulated on the side pieces of the module, and upper parts of the two levers are spread apart by a spacing bar and also by the at least one return roller, and lower parts of the levers each have a means of attachment and an elastic return spring, one end of the spring being attached to an outer side of a respective side piece of the module and an other end of the spring being attached to a respective lever.

3. Dispensing machine as claimed in claim 2, wherein said second lever comprises a long main part having an inner offset at a lower end receiving a shaft, the shaft being articulately mounted in the offset and having a link articulately coupled to an attachment plate for attachment of the return roller and the spacing bar to the second lever.

4. Dispensing machine as claimed in claim 1, wherein each lever is connected to the cover by a shaped link arm of said arms, a first end of each arm being attached to an upper part of the cover and an other end of each arm being attached to a respective lever by a deflection tab formed on the lever.

5. Dispensing machine as claimed in claim 4, wherein each of said arms has a curved slot close to a connecting part to position and move a shaft associated with the deflection tab, thereby to follow and guide the lever during operation of the machine.

6. Dispensing machine as claimed in claim 1, wherein at least one of the arms has an opening in a middle part to receive a locking element formed on a side panel of the housing in order to ensure temporary locking in position of the cover when the cover is raised.

7. Dispensing machine as claimed in claim 1, wherein a front part of the base panel of the housing has a first central curved cut-out and, lengthwise and on a free end, the cover has a plate adapted for elastic deformation in opposition to pressure means, and the plate is located on top of the base panel leaving a gap through which the strip of material can pass and emerge, and a central area of the plate also has a curved cut-out located vertically above the first cut-out.

8. Dispensing machine as claimed in claim 7, wherein the plate presses against an end of L shaped elements integral with a front panel of the housing.

9. Dispensing machine as claimed in claim 8, wherein the pressure means comprises elastic means positioned between a first support and a second support, the first support being integral with an inner face of the plate and the second support being internally integral with an inner face of the cover.

10. Dispensing machine as claimed in claim 8, wherein the pressure means comprises a long, longitudinal leaf, ends of the leaf are attached to the L shaped elements and a central part of the leaf presses against the front panel of the cover, and a spring links the ends of the leaf, the spring being attached to the ends by predetermined positioning holes and, to ensure assembly, one of the ends of the leaf hooks into a connecting part integral with a first of the L shaped elements and an other end of the leaf is attached to a second of the L shaped elements.

* * * * *